US006404137B1

(12) United States Patent
Shodo

(10) Patent No.: US 6,404,137 B1
(45) Date of Patent: Jun. 11, 2002

(54) DISPLAY DEVICE

(75) Inventor: Kenzo Shodo, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/654,068

(22) Filed: Sep. 1, 2000

(30) Foreign Application Priority Data

Sep. 3, 1999 (JP) ..... 11-249955

(51) Int. Cl.[7] ..... G09G 3/10

(52) U.S. Cl. ..... 315/169.1; 315/169.2; 315/169.3; 313/585; 345/46; 345/55

(58) Field of Search ..... 315/169.1, 169.2, 315/169.3; 345/99, 39, 46, 48, 55; 313/581, 585

(56) References Cited

U.S. PATENT DOCUMENTS 5,926,238 A * 7/1999 Inoue et al. ..... 349/61
6,040,810 A * 3/2000 Nishimura ..... 345/87
6,064,158 A * 5/2000 Kishita et al. ..... 315/169.3
6,069,676 A * 5/2000 Yuyama ..... 349/62
6,144,355 A * 11/2000 Murata et al. ..... 345/99

* cited by examiner

*Primary Examiner*—Don Wong
*Assistant Examiner*—Jimmy T. Vu
(74) *Attorney, Agent, or Firm*—Arent Fox Kintner Plotkin & Kahn

(57) ABSTRACT

A combination of a light emitting element and a light receiving element for monitoring the amount of light emitted from the light emitting element are provided. Also, a control circuit is added for controlling the amount of light emitted from the light emitting element in response to an output of the light receiving element. As their combination constitutes a pixel, a plurality of the pixels are arrayed in a matrix form. With the light emitting elements connected to a line for switching on and off the elements, a resultant display device enables to render the pixels uniform in the luminance. As a result, each pixel can emit a desired level of the illumination determined by an input signal regardless of discrete emission characteristics of the pixel, whereby a reproduced image is free from color blurs and creates highly explicit steps of gradation.

9 Claims, 2 Drawing Sheets

DISPLAY DEVICE

FIELD OF THE INVENTION

The present invention relates to a display device being able to be controlled the intensity of light emitted from, e.g., an electro-luminescent (EL) element or a light emitting diode (LED) to illuminate at a desired level of luminance. More particularly, the present invention relates to a display device having a matrix of light emitting elements as the pixels and having uniform emission of light from the pixels without variations, and thus displaying a highly elaborate image with definite steps of gradation.

BACKGROUND OF THE INVENTION

With development of the office automated (OA) instruments, their: displays are increasingly demanded for lowering the power consumption and minimizing the overall size. Common examples of such conventional display devices are CRTs and liquid crystal display panels. Recently, other display devices are focused including a large-screen LED system installed at a corner of a town or a thin, small self-illumination device using EL elements as the display on an OA instrument.

In a conventional CRT, the emission (luminance) of light of each pixel can be changed by controlling the intensity of electron beam but fails to be automatically controlled in response to variations of the phosphoric screen. Also, in a liquid crystal display, the brightness of each pixel can be changed by controlling the duty ratio for duty drive. It however fails to automatically control the brightness in response variations of the color filter.

A self-illumination display device having above mentioned light emitting element, for example an LED or an EL element, functions by driving each pixel with a drive voltage (or current) corresponding to a certain level of input power.

As described above, any conventional display device is designed to be driven by a uniform level of power unless a specific mode of display such as gradations is desired. However, the self-illumination display device using light emitting elements such as LEDs or ELs has their pixels provided independent from each other and may generate non uniformity of their emission. When such light emitting elements which are not uniform in the luminance of emitting light are used in a matrix form as a display, they may yield blurs and noises hence reproducing an image of unfavorable quality. In particular, desirable steps of gradation may hardly be reproduced by a given input power if the pixels emit variations of the luminance.

In reverse, the self-illumination display device using light emitting elements such as LEDs or ELs may favorably be changed in the luminance by controlling the applying power which is higher than a particular threshold level of voltage (or current). Accordingly, when a variation in the illumination is identified, it may adjustably be suppressed to render the illumination uniform.

SUMMARY OF THE INVENTION

The present invention is developed in view of the above aspects and its object is to provide a display device having each light emitting element adjusted to emit a desired level of illumination determined by the input level regardless of its illumination characteristics.

It is another object of the present invention to provide a display device which has a matrix of light emitting elements provided as pixels and is adjusted for controlling the illumination of each pixel thus to display, an image which hardly has blurs or noises and appears with highly definite steps of gradation.

A display device according to the present invention is provided comprising a light emitting element, a light receiving element for monitoring the amount of light emitted from the light emitting element, and a control circuit for controlling the amount of light emitted from the light emitting element according to an output of the light receiving element, whereby the amount of light emitted from the light emitting element can favorably be adjusted.

This allows the light emitting element to be controlled by the action of the control circuit so that an output of the light emitting element corresponds to the input signal (of a given voltage level) irrespective of characteristics of the light emitting element when the light emitting element fails to emit a desired level of light output (luminance).

The control circuit may comprise a comparator for comparing between a voltage of the output of the light receiving element and a voltage of the input signal and a driver MOS transistor for driving the light emitting element, wherein an output of the comparator as the driver signal to the gate of the driver MOS transistor being fed for determining a driving voltage to the light emitting element.

It may be modified in which a plurality of pixels are arrayed in a matrix form, each pixels comprising a group of the light emitting element, the light receiving element, and the drive MOS transistor, the gate of the driver MOS transistor of each pixel being connected to a capacitor for holding a gate voltage of the driver MOS transistor, each pixel also including a control terminal for controlling simultaneously the action of a first switching element for switching on and off the driver signal fed to the gate of the driver MOS transistor and the action of a second switching element for switching on and off the output of the light receiving element fed to the comparator circuit, whereby the light amount of the light emitting element of each pixel can be adjusted by the selecting action of the control terminal. Accordingly, the illumination of the light emitting elements arrayed in a matrix form can be controlled at each pixel respectively.

The driver MOS transistor and the light emitting element may be connected in series between the power source voltage and the ground so that the driver power to the light emitting element can be adjusted by the driver signal fed to the gate of the driver MOS transistor. The illumination of each of the light emitting elements can thus be controlled using a simple construction.

It may also be modified in which while the first switching element of each of the pixels aligned in a column or a row is connected at one end to a driver line, the second switching element of each of the pixels alligned in a column or a row is connected at one end to a monitor line, and the control terminal of each of the pixels aligned in a row or a column is connected to a select line, a first shift register is provided for sequentially scanning the columns or rows of the driver line and the monitor line and a second shift register is provided for sequentially scanning the rows or columns of the select line. Accordingly, while each pixel is selected by scanning the column and the row, its illumination can be controlled to have an image of equality.

It may further be modified in which a plurality of groups are arrayed in a matrix form in a semiconductor substrate, each of the groups constituting said pixel, and comprising the light receiving element, the driver MOS transistor, the capacitor, the first switching element, and the second switching element, and a plurality of light emitting elements, each of which is said light emitting element, are arrayed in a matrix form the light emitting element provided as associated with the each group on the semiconductor substrate and arranged for emitting light from upper and lower surfaces. Accordingly, the display device can be simple in the construction and improved in the high imaging concentration with a minimum of non-illumination area.

DETAILED DESCRIPTION

Figure 1:
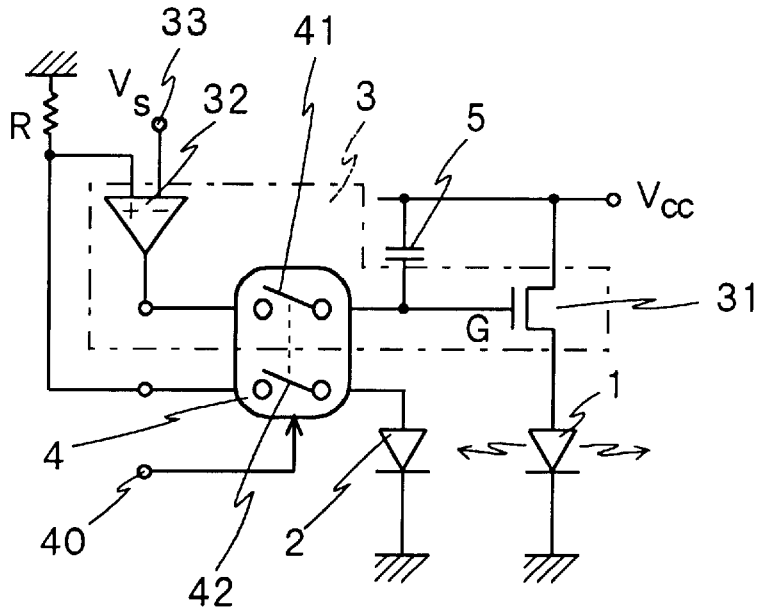
FIG. 1 is an equivalent circuit diagram of a primary part of a structure showing one embodiment of a display device of the present invention.

A display device according to the present invention has a light emitting element 1 and a light receiving element 2 for monitoring the intensity of light emitted from the light emitting element 1 as shown in FIG. 1 of an equivalent circuit diagram of a primary part of the embodiment. A control circuit 3 is provided responsive to an output of the light receiving element 2 for controlling the intensity of light emitted from the light emitting element 1, whereby the emission of light from the light emitting element 1 can be controlled.

The control circuit 3 may comprise a driver MOS transistor 31 for driving the light emitting element 1 and a comparator circuit 32 as shown in FIG. 1. The comparator circuit 32 compares a voltage, which has been converted from a current output of the light receiving element 2 by means of a resistor R, with the voltage $V_s$ of an input signal inputted at a terminal 33. An output of the comparator circuit 32 is transferred to the gate G of the driver MOS transistor 31 for controlling the output of the MOS transistor 31 so that the voltage converted by the resistor R from the output of the light receiving element 2 becomes equal to the input signal voltage $V_s$ (of a setting level) inputted at the terminal 33. More particularly, the action of the driver MOS transistor 31 is controlled by a driver signal from the comparator circuit 32 for allowing the intensity of light of the light emitting element 1 equivalent to the intensity of light being driven by the input signal voltage $V_s$.

Figure 3:
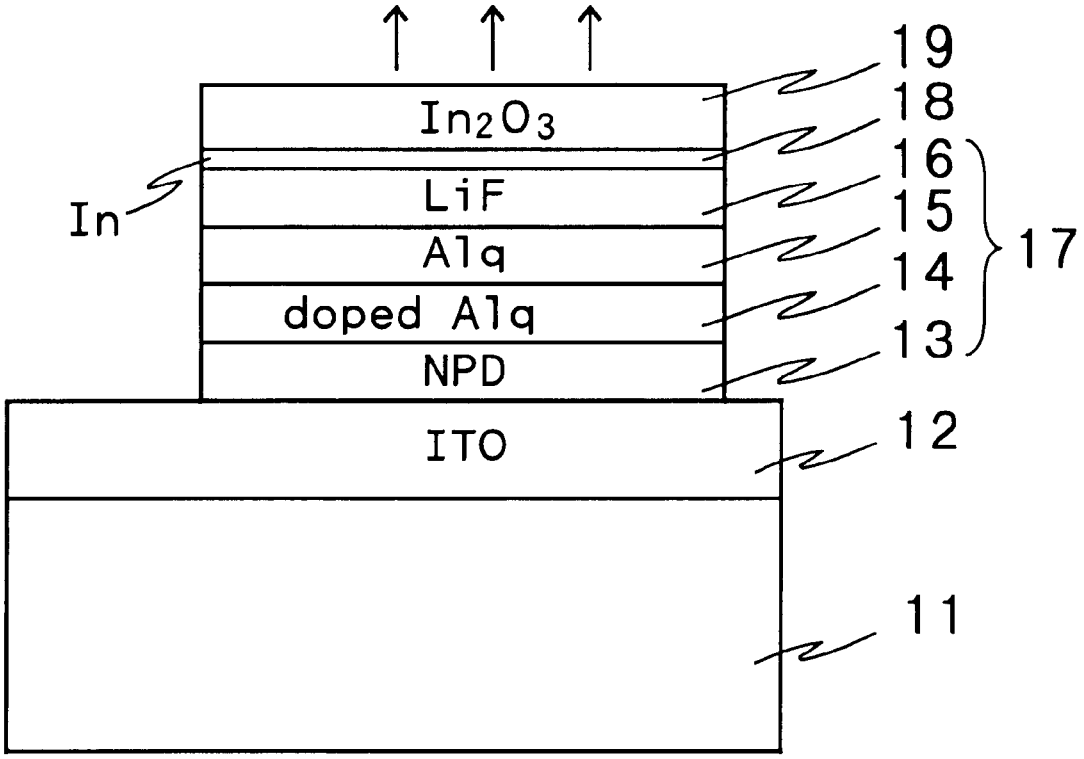
FIG. 3 is an explanatory cross sectional view of an organic EL element which serves as the light emitting element shown in FIG. 1.

The light emitting element 1 may be an organic EL element shown in an explanatory cross sectional view of FIG. 3, which comprises a positive electrode 12 of an ITO film provided on the surface of a silicon substrate 11 and an organic layer 17 deposited on the positive electrode 12, the organic layer 17 comprising a hole transfer layer 13 of e.g. NPD having a thickness of substantially 600 angstroms, an EL layer 14 of Alq doped with 1% by weight of quinacridone or cumarone and having a thickness of substantially 300 angstroms, an electron transfer layer 15 of Alq having a thickness of substantially 300 angstroms, and an electron injection layer 16 of LiF having a thickness of substantially 5 angstroms. The organic layer 17 is not limited to the above arrangement but may be implemented by any structure having at least an EL layer 14. The above multi-layer structure is preferably employed for improving the injection of charges (carriers). In addition, a negative electrode 19 of indium oxide (for example, $In_2O_3$) having a thickness of substantially 1500 angstroms is provided over the multi-layer arrangement via a light transmissive In metal layer 18 having a thickness of a few angstroms to 100 angstroms.

As clearly understood, the light emitting element 1 has not a light absorbing layer on each side of the light emitting layer. Also, the two electrodes are made of transparent materials. Accordingly, the light receiving element is provided preferably on a side opposite to the displaying surface,; for monitoring the illumination of light. Significantly, the substrate 11 is a silicon substrate which is imcorporated the light receiving element 2 and the driver MOS transistor 31. Even though the display device employs a matrix of the light emitting elements 1, a control circuit for controlling the light emitting elements 1 can be realized with ease and the overall size of the display device can be made compact. The matrix of the light emitting elements 1 arrayed as pixels may be fabricated by depositing the foregoing layers over a silicon substrate and etching a resultant assembly to have a desired lattice pattern.

The light receiving element 2 may comprise a photodiode or a photo-transistor having a multi-layer semiconductor for absorbing light emitted from the light emitting element 1. As described, when the light emitting element 1 is provided on the silicon substrate 11, its illumination towards the substrate 11 can be monitored by the light receiving element 2. So, the light emitting element 1 can thus be formed as an organic EL element having the above described arrangement on the silicon substrate 11 assembled in advance with the light receiving element 2 and the driver MOS transistor 31.

In the embodiment shown in FIG. 1, a control switch 4 is provided which comprises a first switching element 41 connected to the gate G of the driver MOS transistor 31 in which is inputted the drive signal input and a second switching element 42 connected to the output side of the light receiving element 2. A control terminal 40 is also provided for controlling the switching actions of the two switching elements 41 and 42 at one time. The two switching elements 41 and 42 may comprise MOS transistors as described later. With a matrix of the pixels, each pixel comprising a pair of the light emitting element 1 and the light receiving element 2, the action of the switching elements 41 and 42 can control the illumination of the light emitting element 1 of each pixel. More specifically, the illumination of each pixel can be in order adjusted by selecting a select line connecting to the control terminal 40 of the control switch 4, a monitor line for outputting the monitor output of the light receiving element 2, and a driver line for applying the drive signal.

In the embodiment shown in FIG. 1, a capacitor 5 for maintaining the gate voltage is connected between the gate G of the driver MOS transistor 31 and the power source voltage $V_{cc}$. As multiple pairs of the light emitting element 1 and the light receiving element 2 are arranged in the matrix form to constitute the display device, the selection of each of pixels is based on line-sequential scanning. For allowing the light emitting element 1 to continuously illuminate with its pixel not selected because of another pixel being selected, the drive signal can continuously be applied to the gate G of the driver MOS transistor 31 by the action of the capacitor 5.

Figure 2:
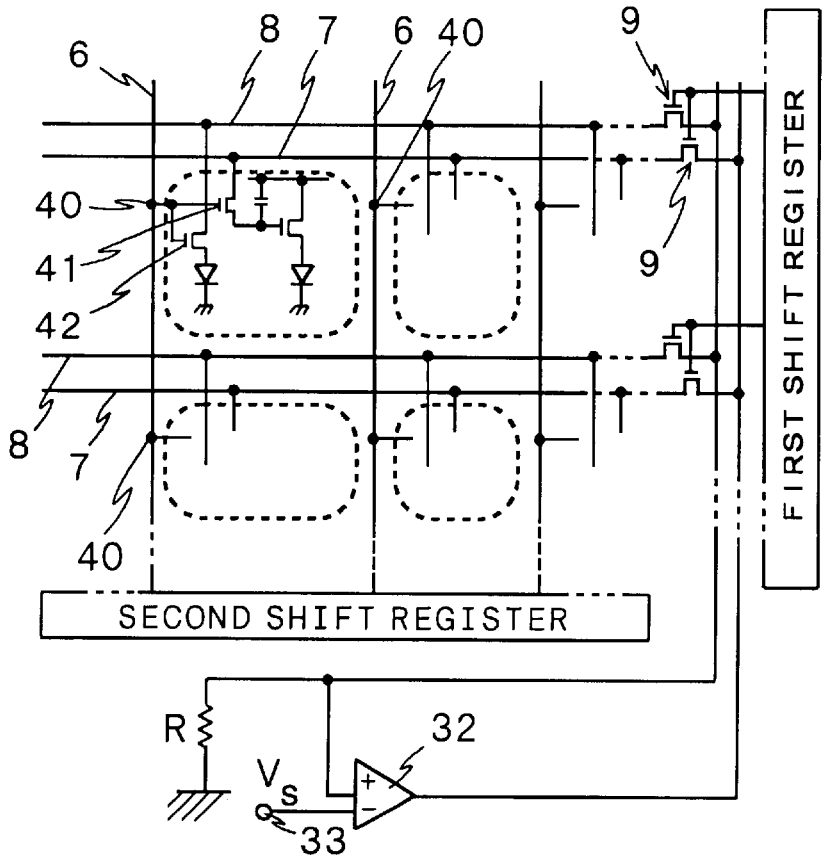
FIG. 2 is an explanatory view of a matrix of the structures of the display device shown in FIG. 1.

FIG. 2 is an equivalent circuitry diagram showing a matrix of the display devices shown in FIG. 1 in which each pixel consists mainly of the light emitting element 1 and the light receiving element 2. As shown in FIG. 2, each pixel is an area defined by the dashed line, having the first switching element 41 and the second switching element 42 implemented in the form of MOS transistors. The control terminals 40 of the two switching elements 41 and 42, aligned along a row of the matrix are connected to the vertical(row direction) select line 6. For feeding the drive signal via the first switching element 41 to the gate G of the driver MOS transistor 31, the first switching elements 41 aligned along a column are connected at one end to the horizontal(column direction) driver line 7. The light receiving elements 2 aligned in a column are connected at their output to the horizontal monitor line 8 through the second switching element 42.

The select lines 6 extending along rows are connected to a second shift register for sequential scanning. The monitor lines 8 extending along columns are connected to the reference voltage level GND via a resistor R provided for converting an output current developed by the electromotive force of each light receiving element 2 to a voltage. The voltage produced by the resistor R is then supplied to one of two inputs of the comparator circuit 32 where it is compared with the setting level $V_s$ (input signal) inputted at the other input. It is examined whether the intensity of light received by the light receiving element 2 is higher or lower than the setting level. A result of the comparison is transmitted to the driver line 7 and transferred to the gate G of the driver MOS transistor 31. The driver line 7 and the monitor line 8 of each column are connected to a first shift register via their corresponding switching elements 9 composed of MOS transistors for sequential scanning.

In the arrangement, the desired pixel can be selected by sequentially selecting their corresponding rows and columns. Both the first and the second switching element 41 and 42 of each pixel are turned on at one time. So when the gate G of the driver MOS transistor 31 receives a driver signal, simultaneously, the output voltage of the light receiving element 2 representing the illumination is compared with the setting level $V_s$ by the comparator circuit 32 and the driver signal is adjusted to such a level that the illumination corresponds to the setting voltage. The level of the driver signal causing the illumination to correspond rightly to the setting voltage is held in the capacitor 5, the control switch 4 is turned off, and the action of selecting the pixel is terminated. When the selecting action has been completed, the driver signal remains saved in the capacitor 5, thus allowing the light emitting element 1 of the pixel to emit a controlled intensity of light continuously.

When another pixel is selected and its relevant setting voltage is applied as the driver signal of turn-off action, the light emitting element 1 receives a zero voltage, thus emitting no light and its state remains until the next selecting action is initiated. In case that an intermediate intensity of light is needed for displaying steps of gradation, its relevant voltage can be assigned as the setting level $V_s$ to produce the illumination corresponding to the level.

The display device according to the present invention, when having a light emitting element of self-illumination type, includes a control circuit for monitoring the illumination of light emitted from the light emitting element and controlling the illumination to a level determined by the input signal (of a setting voltage level), hence maintaining the brightness of light at a desired level. When a plurality of the light emitting elements arrayed in a matrix form produce different intensities of light due to deficiencies during the production, they can separately be modified to have a uniform level of the illumination. As a result, the display device can reproduce a highly elaborate image on its screen without generating significant blurs or noises.

In case that steps of gradation are desired with the pixels generating brightness and darkness, each step can be expressed by a precise level of the input signal hence yielding a very definite quality of gradation. As the input signal (of a setting voltage level) is modified in analog mode, it can accurately generate a corresponding level of brightness thus improving the quality of gradation.

As the substrate is made of a silicon, the light receiving elements 2, the driver MOS transistors 31, the control switches 4, and the signal retaining capacitors 5 can be built in a matrix form in the silicon substrate. More over, the light emitting elements 1 such as organic EL elements with their control circuits 3 can precisely be built in a matrix form over the assembly by depositing transparent electrodes and organic films and patterning them to a desired shape. Accordingly, the resultant display device has pixels provided at a higher concentration.

The display device of the present invention has a control circuit for monitoring the illumination of light emitted from the light emitting element using the light receiving element and controlling the illumination to a level determined by the input signal, whereby a desired level of the illumination determined by the input signal can constantly be obtained regardless of discrepancies during the production. When the display device has a large screen made of a multiplicity of the light emitting elements arrayed in a matrix, it may hardly produce color blurs or noises on the screen of pixels and can thus be improved in the displaying characteristics. In case that steps of gradation is desired, each pixel can precisely generate a level of illumination determined by the input signal, hence contributing to the displaying of a highly definite image.

Moreover, the display device has such a structure that light can be emitted from both sides of a light emitting element provided with transparent electrodes as developed on a semiconductor, such as silicon, substrate. This prevents leakage of light between neighbor pixels and allows the primary arrangement including a light receiving element and a control circuit to be built directly in the substrate, hence minimizing the non-illuminating area of each pixel. Also, the display device with a higher pixel concentration can be fabricated at less cost by rather simple steps of the production.

Although preferred example have been described in some detail it is to be understood that certain changes can be made by those skilled in the art without departing from the spirit and scope of the invention as defined by the appended claims.

What is claimed is:

1. A display device comprising:

a light emitting element;

a light receiving element for monitoring the amount of light emitted from said light emitting element; and a control circuit for controlling the amount of light emitted from said light emitting element according to an output of said light receiving element;

wherein a plurality of sets of said light emitting elements and said light receiving elements are provided so that each set of said plurality of sets constitutes a pixel in a display, and wherein in each of said pixels the amount of light emitted from said light emitting elements is favorably adjusted.

2. A display device according to claim 1, wherein said control circuit comprises:

a comparator circuit for comparing between a voltage of the output of said light receiving element and a voltage of the input signal; and a driver MOS transistor for driving said light emitting element;

wherein an output of said comparator circuit as a driver signal being fed to the gate of said driver MOS transistor for determining a driving voltage to said light emitting element.

3. A display device according to claim 2, wherein a plurality of pixels are arrayed in a matrix form, each pixels comprising a group of said light emitting element, said light receiving element, and said driver MOS transistor, the gate of said driver MOS transistor of each pixel being connected to a capacitor for holding a gate voltage of said driver MOS transistor, each pixel also including a control terminal for controlling simultaneously the action of a first switching element for switching on and off said driver signal fed to the gate of said driver MOS transistor and the action of a second switching element for switching on and off the output of said light receiving element fed to said comparator circuit, whereby the light amount of said light emitting element of each pixel can be adjusted by the selecting action of said control terminal.

4. A display device according to claim 2, wherein said driver MOS transistor and said light emitting element are connected in series between the power source voltage and the ground so: that the driver power to said light emitting element can be adjusted by said driver signal fed to the gate of said driver MOS transistor.

5. A display device according to claim 3, wherein said first and second switching elements comprise MOS transistors of which the gates are connected to a select line so that said first and second switching elements can simultaneously be controlled from the select line.

6. A display device according to claim 3, wherein while said first switching element of each of said pixels aligned in a column or a row is connected at one end to a driver line, said second switching element of each of said pixels alligned in a column or a row is connected at one end to a monitor line, and said control terminal of each of said pixels aligned in a row or a column is connected to a select line, a first shift register is provided for sequentially scanning the columns or rows of said driver line and said monitor line and a second shift register is provided for sequentially scanning the rows or columns of said select line, whereby a desired pixel can be selected.

7. A display device according to claim 3, wherein a plurality of groups are arrayed in a matrix form in a semiconductor substrate, each of said groups constituting said pixel, and comprising said light receiving element, driver MOS transistor, said capacitor, said first switching element, and said second switching element, and a plurality of light emitting elements, each of which is said light emitting element, are arrayed in a matrix form, said light emitting element provided as associated with said each group on said semiconductor substrate and arranged for emitting light from upper and lower surfaces.

8. A display device according to claim 7, wherein said light emitting element comprises an organic EL element.

9. A display device according to claim 8, wherein said light emitting element is formed by depositing transparent electrode layers and organic layers on said semiconductor substrate and separating said layers to pieces by etching.

* * * * *